United States Patent [19]

Sagisaka et al.

[11] Patent Number: 4,800,859

[45] Date of Patent: Jan. 31, 1989

[54] FUEL PUMP CONTROL APPARATUS

[75] Inventors: Yasuo Sagisaka; Ryuichi Sano, both of Obu, Japan

[73] Assignee: Nippondenso Co., Ltd., Kariya, Japan

[21] Appl. No.: 65,854

[22] Filed: Jun. 24, 1987

[30] Foreign Application Priority Data

Jun. 25, 1986 [JP] Japan ..... 61-148382

[51] Int. Cl.[4] ..... F02M 37/08; F02M 39/02

[52] U.S. Cl. ..... 123/497; 123/459; 123/463; 123/494

[58] Field of Search ..... 123/497, 482, 511, 456, 123/457, 458, 459, 463, 506, 494

[56] References Cited

U.S. PATENT DOCUMENTS

| | | | |
|---|---|---|---|
| 4,205,648 | 6/1980 | Graham | 123/497 |
| 4,248,194 | 2/1981 | Drutchas | 123/497 |
| 4,426,978 | 1/1984 | Sasaki et al. | 123/459 X |

FOREIGN PATENT DOCUMENTS

| | | | |
|---|---|---|---|
| 2365088 | 12/1973 | Fed. Rep. of Germany | 123/497 |
| 58-48765 | 3/1983 | Japan | 123/497 |
| 58-48766 | 3/1983 | Japan | 123/497 |
| 58-48767 | 3/1983 | Japan | 123/497 |
| 59-39960 | 3/1984 | Japan | 123/197 |
| 60-147563 | 8/1985 | Japan | 123/497 |
| 60-147564 | 8/1985 | Japan | 123/497 |

*Primary Examiner*—Willis R. Wolfe

*Attorney, Agent, or Firm*—Cushman, Darby & Cushman

[57] ABSTRACT

A vehicle fuel pump control apparatus controls the operating speed of a fuel pump to adjust the quantity of fuel forced to at least one fuel injector. When the required fuel quantity of the engine which is based on its operating condition is determined to be greater than a reference level predetermined in correspondence to the operating condition, the pump operating speed is increased, whereas the pump operating speed is decreased when the required fuel quantity is determined smaller than the reference level. When an insufficient fuel supply is detected during the low speed operation, the reference level is updated or readjusted to a lower level in such a manner that the required fuel quantity is determined greater than the corrected level.

16 Claims, 10 Drawing Sheets

FUEL PUMP CONTROL APPARATUS

BACKGROUND OF THE INVENTION

1. Field of the Invention

The present invention relates to a fuel pump control apparatus for controlling the operating speed of a fuel pump which is used, for example, with a vehicle engine, so as to force the fuel to be supplied to the fuel injectors of the engine.

2. Description of the Prior Art

In the past, a fuel pump control apparatus of this type has been disclosed in Japanese Unexamined Publication No. 60-147563.

The fuel pump control apparatus disclosed in the above publication is constructed so that the operating speed of a fuel pump is changed from one speed to another in accordance with the quantity of fuel injected per unit time from each fuel injector and the intake air pressure. This has the effect of not only producing merits such as the elimination of wasteful operation of the fuel pump, a reduction in the pump operating sound during the idling period and an improvement in the pump life, but also preventing the quantity of fuel supplied to the fuel injectors from the fuel pump from becoming less than the quantity of fuel injected, thereby preventing the danger of causing any undersupply of the fuel.

However, since the fuel pump is deteriorated in performance as it is used over a long period of time, even if the applied voltage to the motor for the fuel pump is the same, the rotating capacity of the motor is deteriorated so that after a long period of use, the operating speed of the fuel pump is decreased as compared with the initial operating speed and therefore the quantity of fuel supplied to the fuel injectors is decreased.

When the deterioration in the performance of the fuel pump proceeds in this way, where the fuel pump is controlled to operate at a low speed and moreover the fuel pump is being operated in a condition close to a level at which the switching from the low speed to the high speed takes place, there is a disadvantage that in contrast to the performance during the initial use period which is capable of supplying the fuel in an amount which has some margin over the required fuel injection quantity, the reduced fuel supply quantity due to the reduced operating speed gives rise to a situation in which the quantity of fuel supplied is less than the quantity of fuel injected and the engine is not operated smoothly.

SUMMARY OF THE INVENTION

It is therefore an object of the present invention to provide a fuel pump control apparatus which overcomes the foregoing deficiencies in the prior art.

It is another object of the invention to provide a fuel pump control apparatus which is capable of ensuring a stable supply of fuel from a fuel pump over a long period of time while maintaining a low speed operating condition of the fuel pump throughout a wide range of engine operating conditions.

Thus, as shown in FIG. 12, there is provided a fuel pump control apparatus of the type which controls the operating speed of a fuel pump to adjust the quantity of fuel forced to at least one fuel injector, and the apparatus includes operating condition detecting means for detecting the operating condition of an engine, discriminating means responsive to the detected operating condition to determine whether the required fuel quantity of the engine is greater than a given quantity in accordance with a predetermined reference level, speed change means for increasing the operating speed of the fuel pump when the discriminating means determines that the required fuel quantity is greater than the given quantity and decreasing the operating speed of the fuel pump when the required fuel quantity is less than the given quantity, fuel undersupply condition detecting means for detecting an undersupply condition of the fuel supplied to the engine when the fuel pump is operated at the low speed by the speed change means, and correcting means responsive to the detection of the fuel undersupply condition to correct the reference level in a direction such that the required fuel quantity is determined less than the given quantity.

With the above-described construction, the operating speed of the fuel pump is changed by the speed change means in accordance with the required fuel quantity of the engine and the quantity of fuel corresponding to the required fuel quantity of the engine is supplied to the fuel injector from the fuel pump. In addition, when the fuel undersupply condition detects that the fuel quantity to the fuel injectors from the fuel pump is less than the required fuel quantity of the engine or is tending to become so, it is considered that the operating speed of the fuel pump is decreased as compared with the initial speed due to its deteriorated performance and the reference level of the discriminating means is corrected by the correcting means.

DESCRIPTION OF THE PREFERRED EMBODIMENTS

Figure 1:
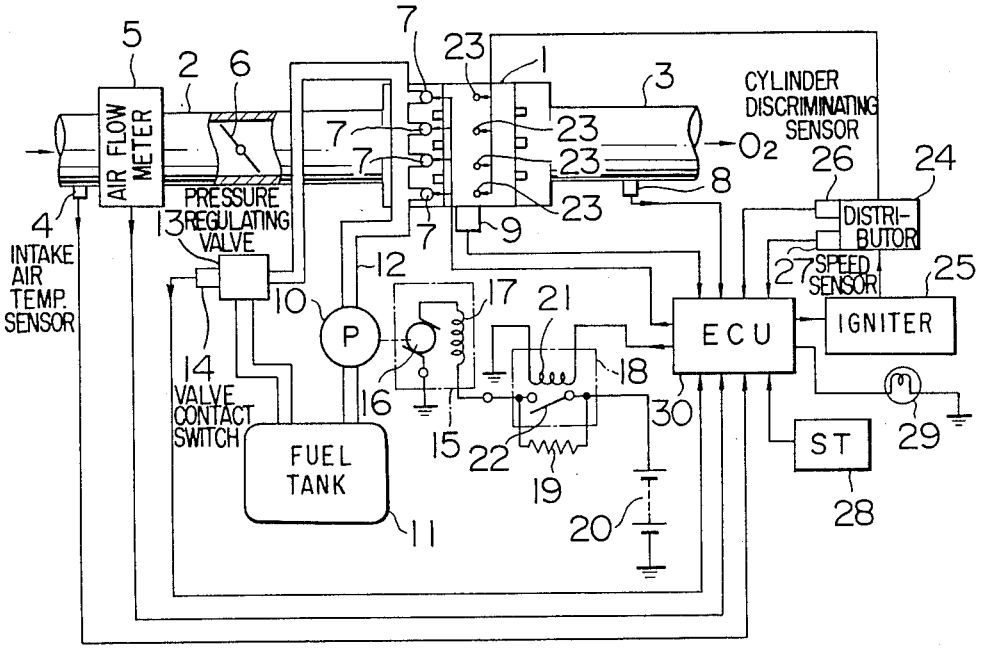
FIG. 1 is a schematic diagram showing the arrangement of an engine incorporating the construction of a first embodiment of the invention and peripheral units.

Referring to FIG. 1, numeral 1 designates a spark ignition-type four cylinder engine for vehicles, and an intake pipe 2 and an exhaust pipe 3 are connected to the engine 1. Arranged in the intake pipe 2 from the upstream side are an air cleaner (not shown), an intake air temperature sensor 4, an air flow meter 5, a throttle valve 6 and fuel injection valves 7 (hereinafter referred to as injectors), and also arranged in the exhaust pipe 3 from the upstream side are an $O_2$ sensor 8 and a catalytic converter (not shown). In addition, the engine 1 is provided with a water temperature sensor 9 for detecting the temperature of the engine cooling water.

Numeral 10 designates a fuel pump for forcing the fuel stored in a fuel tank 11 to the injectors 7 through a pipe line 12. Also disposed in the pipe line 12 is a pressure regulating valve 13 for adjusting the pressure of the fuel supplied to the injectors 7 to a given pressure. The pressure regulating valve 13 adjusts the fuel pressure by returning a part of the fuel, which is supplied to the injectors 7 from the fuel pump 10, to the fuel tank 11.

Figure 2:
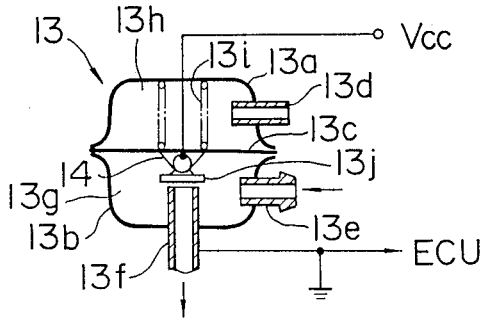
FIG. 2 is a diagram showing the construction of the pressure regulating valve shown in FIG. 1.

The pressure regulating valve 13 is constructed as shown in FIG. 2 with a diaphragm 13*c* made of a rubber member being held between the end of an upper housing 13*a* and the end of a lower housing 13*b*. The upper housing 13*a* is provided with a pipe 13*d* to which is connected a rubber hose (not shown) which introduces the pressure in the area of the intake pipe 2 downstream of the throttle valve 6, and the lower housing 13*b* is provided with an induction pipe 13*e* and a discharge pipe 13*f* which are connected to the pipe line 12 so that a part of the fuel forced to the injectors 7 from the fuel pump 10 is introduced into a fuel chamber 13*g* defined by the lower housing 13*b* and the diaphragm 13*c* through the induction pipe 13*e*. The fuel within the fuel chamber 13*g* is discharged to the fuel tank 11 through the discharge pipe 13*f*. A spring 13*i* for pressing the diaphragm 13*c* is mounted within a back pressure chamber 13*h* defined by the upper housing 13*a* and the diaphragm 13*c*. In addition, the diaphragm 13*c* is provided with a valve 13*j* on the side of the fuel chamber 13*g* for cooperation therewith, the valve 13*j* opposing the open end of the discharge pipe 13*f* which projects into the fuel chamber 13*g*.

Then, the valve 13*j* and the discharge pipe 13*f* of the pressure regulating valve 13 form two contacts of an electric switch (a valve contact switch 14) which closes when the two come into contact. In other words, when the valve contact switch 14 is closed, it is an indication that during the operation of the engine 1 the fuel quantity introduced into the fuel chamber 13*g* through the induction pipe 13*e* is reduced to zero and thus the valve 13*j* is seated at the open end of the discharge pipe 13*f*. In other words, this is an indication of the occurrence of the danger that a quantity of fuel supplied to the injectors 7 from the fuel pump 10 has become less than the quantity of fuel injected from the injectors 7.

The fuel pump 10 is operated by a dc motor 15 which includes an armature 16 and a field winding 17. The dc motor 15 is connected to a battery 20 through a parallel circuit of a relay 18 and a resistor 19 so that a switch 22 of the relay 18 is opened and closed in dependence on the presence and absence of the current flow to a coil 21 of the relay 18 and the voltage applied to the dc motor 15 is adjusted in accordance with the opening and closing of the switch 22.

The engine 1 is provided with spark plugs 23 connected to a distributor 24 which in turn is connected to an igniter 25. A cylinder discriminating sensor 26 and a speed sensor 27 are mounted on the distributor 24.

Numeral 28 designates a starter switch which is turned on when the starter is in operation. Numeral 29 designates a warning lamp.

Numeral 30 designates an electronic control unit (hereinafter referred to as an ECU), and the ECU 30 receives the detection signals from the previously mentioned sensors and switches to output the resulting control signals to the injectors 7, the relay 18 and the igniter 25, respectively.

Figure 3:
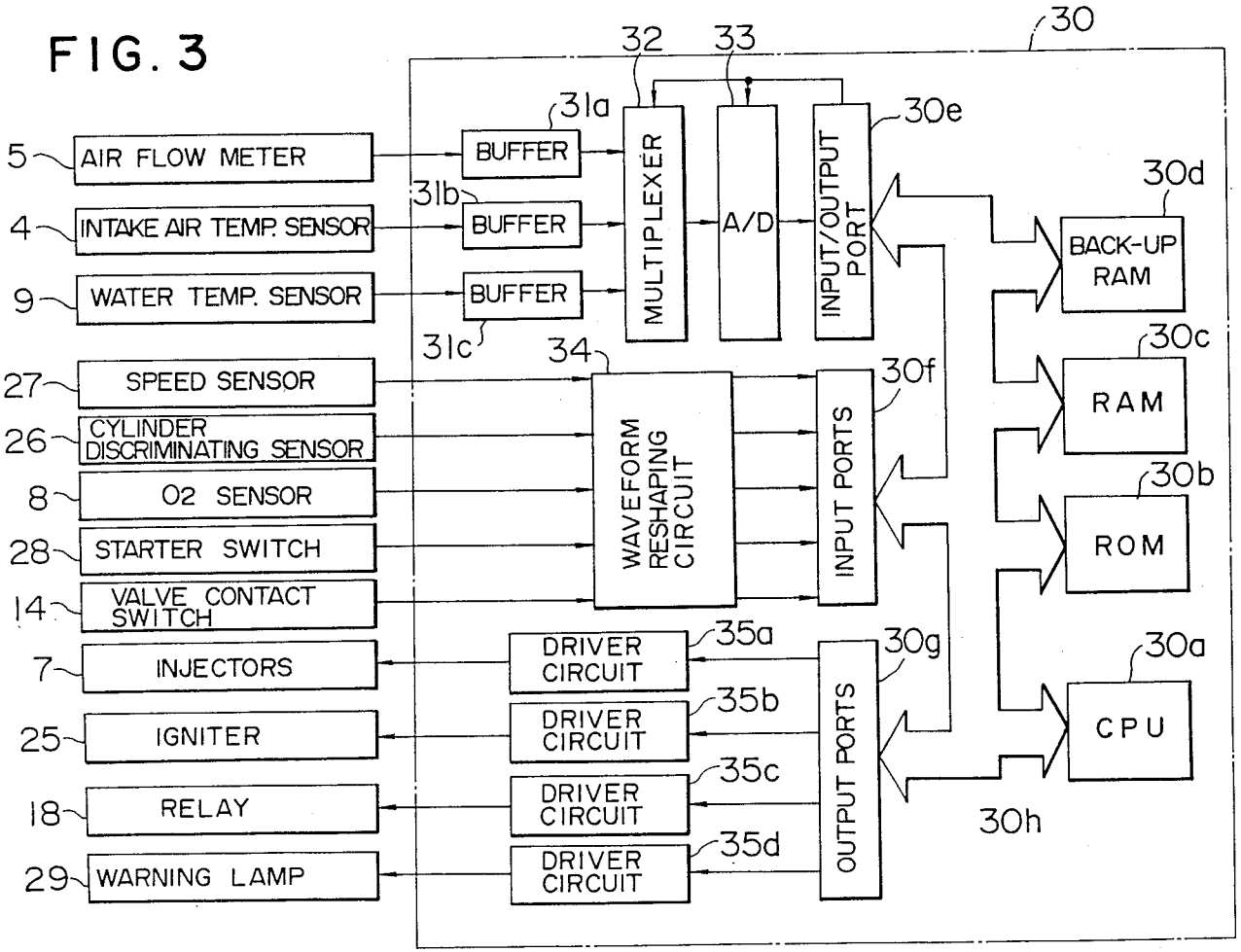
FIG. 3 is a block diagram showing the construction of the ECU shown in FIG. 1.

The ECU 30 is constructed as shown in FIG. 3 and comprises a microcomputer including a central processing unit (CPU) 30*a*, a read-only memory (ROM) 30*b*, a random access memory (RAM) 30*c*, a back-up random access memory (back-up RAM) 30*d*, an input/output port 30*e*, input ports 30*f* and output ports 30*g*, and the CPU 30*a*, the ROM 30*b*, the RAM 30*c*, the back-up RAM 30*d*, the input/output port 30*e*, the input ports 30*f* and the output ports 30*g* are interconnected through a bus 30*h*.

The air flow meter 5, the intake air temperature sensor 4 and the water temperature sensor 9 are connected to the input/output port 30*e* through buffers 31*a* to 31*c*, respectively, a multiplexer 32 and an A/D converter 33. The multiplexer 32 and the A/D converter 33 are controlled by the signals generated from the input/output port 30*e* to successively input the signals from the air flow meter 5, the intake air temperature sensor 4 and the water temperature sensor 9.

The speed sensor 27, the cylinder discriminating sensor 26, the $O_2$ sensor 8, the starter switch 28 and the valve contact switch 14 are connected to the input port 30*f* through a waveform reshaping circuit 34.

The injectors 7, the igniter 25, the relay 18 and the warning lamp 29 are respectively connected through driver circuits 35*a*, 35*b*, 35*c* and 35*d* to the output ports 30*g*.

With the CPU 30*a* of the ECU 30 which is constructed as described, a basic fuel injection time TAU is determined in accordance with the intake air flow signal $Q_A$ from the air flow meter 5 and the speed signal N from the speed sensor 27 by a well known method. In addition, the correction factors respectively corresponding to the intake air temperature signal THA from the intake air temperature sensor 4 and the water temperature signal THW from the water temperature sensor 9 are read from the ROM 30*b* to correct the basic injection time TAU and the basic injection time TAU is further corrected by the feedback correction factor calculated in accordance with the rich or lean signal from the $O_2$ sensor 8, thereby computing an effective injection time $T_e$. Then, a dead injection time preset in accordance with the voltage condition of the battery 20 is added to the effective injection time $T_e$, thereby determining an injection time $T_{out}$ of the injectors 7.

Also, the ignition timing is determined by the CPU 30 by a known method, that is, a basic ignition timing $Ig_{base}$ is read from the map within the ROM 30*b* in accordance with the intake air flow signal $Q_A$ and the speed signal N and the basic ignition timing $Ig_{base}$ is corrected in accordance with the intake air temperature signal THA, the water temperature signal THW, etc., thereby determining an ignition timing $Ig_{out}$.

Then, in response to the reference signal from the cylinder discriminating sensor 26, the injection time $T_{out}$ and the ignition timing $Ig_{out}$ are outputted from the output ports 30*g* to the driver circuit 35*a* and 35*b*, respectively, and the injector 7 and the igniter 25 are controlled by the driving signals from the driver circuits 35*a* and 35*b*, respectively.

It is to be noted that the calculation and outputting of the injection time $T_{out}$ and the ignition timing $Ig_{out}$ are effected in accordance with the programs stored in the ROM 30*b*.

The control of the fuel pump 10 will now be described. Note that the control program of the fuel pump 10 is also stored in the ROM 30*b* as in the case of the previously mentioned control programs.

Figure 4:
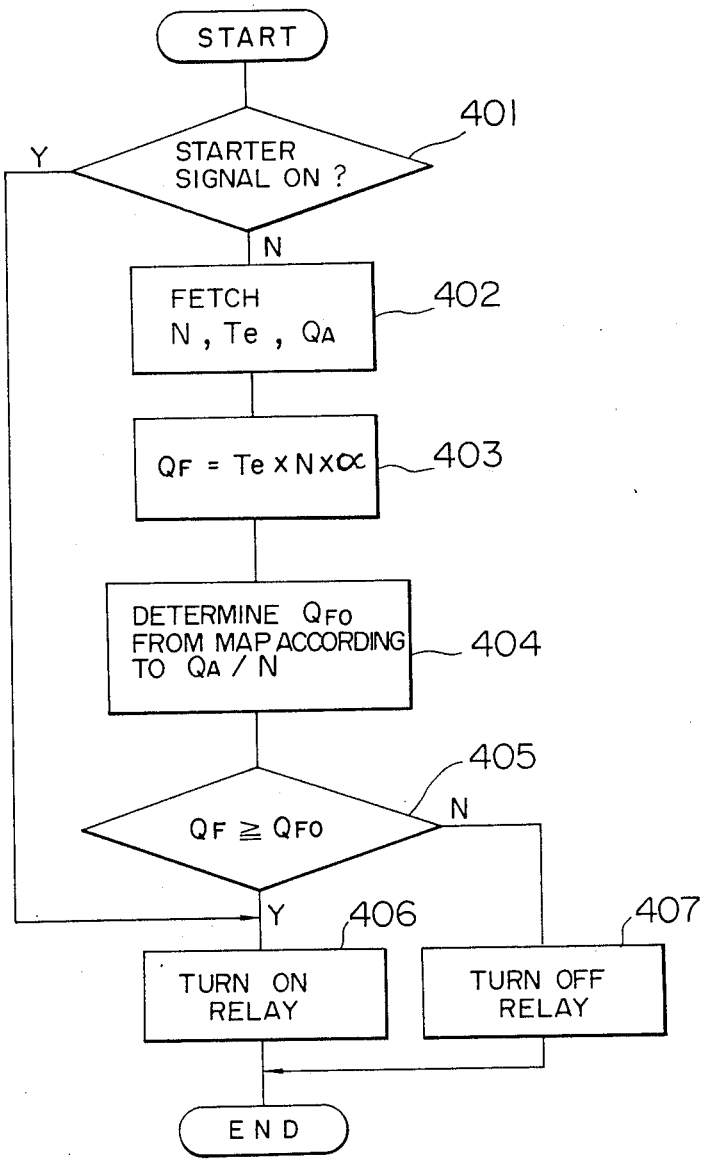
FIG. 4 is a flow chart showing a fuel pump operation mode changeover control routine executed in the CPU shown in FIG. 3.

FIG. 4 shows a flow chart of the control routine for adjusting the voltage applied to the dc motor 15 for the fuel pump 10 and this routine is executed in response to a timer interrupt at intervals of 4 ms. Firstly, when this routine is initiated by the interruption, at a step 401, it is determined whether the starter signal from the starter switch 28 is on so that if it is, a transfer is made to a step 406 bypassing steps 402 to 405 and a command is applied to the output ports 30*g* to turn on the relay 18, thereby completing the present routine.

When this occurs, the driver circuit 35*c* energizes the coil 21 of the relay 18 so that the switch 22 is closed and a high voltage is applied to the dc motor 15. Thus, the fuel pump 10 is operated at a high speed and a large quantity of the fuel is forced to the injectors 7.

On the contrary, if the starter signal is off at the step 401, a transfer is made to the step 402 so that the speed signal N, the intake air flow signal $Q_A$ and the effective injection time $T_e$ are inputted. At the step 403, the required fuel quantity of the engine 1 for the time $T_e$ is determined in accordance with the speed signal N and the effective injection time $T_e$ from the following equation $$Q_F = T_e \times N \times \alpha$$

Here, $\alpha$ is a constant which is determined by the characteristics of the injectors 7 and the number of the cylinders in the engine 1.

Figure 5:
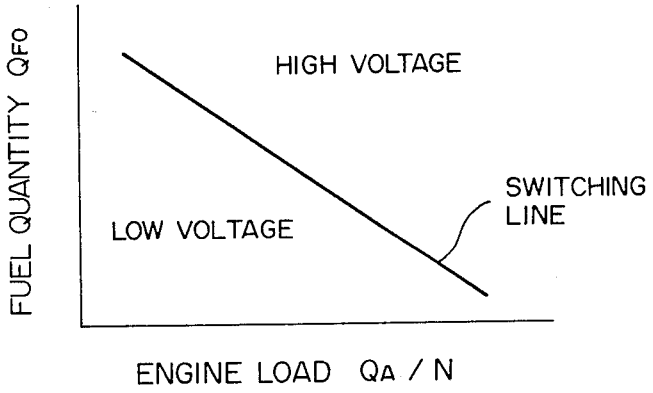
FIG. 5 is a map used with the control routine shown in FIG. 4.

At the step 404, in accordance with the engine load $Q_A/N$ obtained from the speed signal N and the intake air flow signal $Q_A$ inputted at the step 402, a fuel quantity $Q_{F0}$ which is deliverable in the low voltage range or the low speed operation mode of the fuel pump 10 is determined in accordance with the switching line stored in the back-up RAM 30*d* as shown in FIG. 5. It is to be noted that the fuel must always be returned to the fuel tank 11 through the pressure regulating valve 13 so as to effect the fuel pressure adjustment properly and therefore this returned fuel quantity is taken into consideration to preset the fuel quantity $Q_{F0}$ to one which is reduced by the returned fuel quantity.

At the step 405, the required fuel quantity $Q_F$ determined at the step 403 is compared with the fuel quantity $Q_{F0}$ determined at the step 404 so that a transfer is made to a step 406 if $Q_F \geqq Q_{F0}$ and a transfer is made to a step 407 if $Q_F < Q_{F0}$.

At the step 406, a command is applied to the output port 30*g* to turn on the relay 18 and the present routine is completed as mentioned previously. On the contrary, at the step 407, a command is applied to the output port 30*g* to turn off the relay 18 thereby completing the routine.

By controlling in this way, when the relay 18 is turned on, the voltage of the battery 20 is supplied as such to the dc motor 15 through the switch 22 and not through the resistor 19 and the fuel pump 10 is operated at a high speed. This high speed operation of the fuel pump 10 increases the quantity of fuel supplied to the injectors 7 and the fuel quantity required by the engine 1 is ensured.

On the other hand, when the relay 18 is turned off, the current flow to the coil 21 is interrupted so that the switch 22 is opened and the voltage of the battery 20 is supplied in reduced form to the dc motor 15 through the resistor 19.

As a result, while the fuel pump 10 is operated at a low speed so that the quantity of fuel supplied from the fuel pump 10 is decreased, the required fuel quantity of the engine 1 is now reduced and therefore the quantity of fuel supplied to the injectors 7 from the fuel pump 10 covers the required fuel quantity fully. On the other hand, the operating speed of the fuel pump 10 is reduced with the resulting elimination of any wasteful operation of the fuel pump 10 including the dc motor 15.

Next, the operation of detecting the occurrence of deterioration in, for example, the dc motor 15 of the fuel pump 10 and providing the compensation corresponding to the deterioration will be described.

Figure 6:
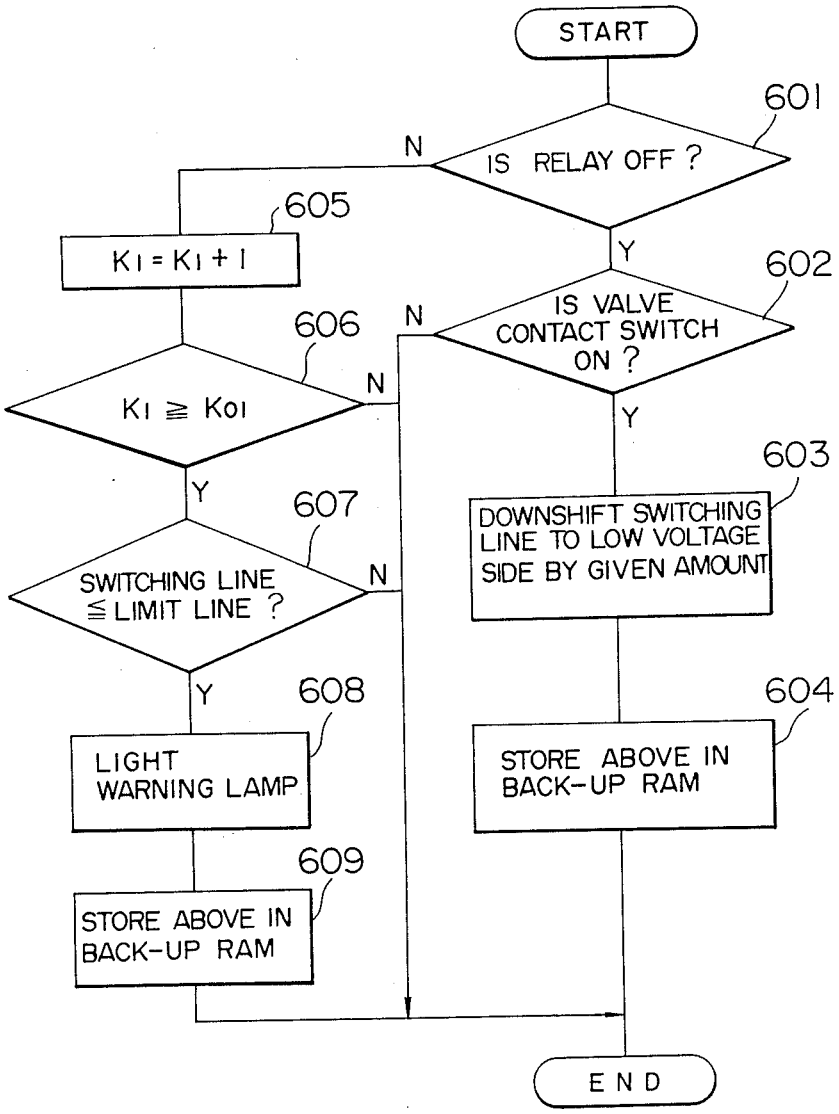
FIG. 6 is a flow chart of a control routine which is executed in the CPU of FIG. 3 to perform the correction of the switching line and the discrimination of the fuel pump life limit.

FIG. 6 is a flow chart showing a control routine for performing the above-mentioned control operation and this routine is executed by interruption at intervals of 20 ms.

Figure 7:
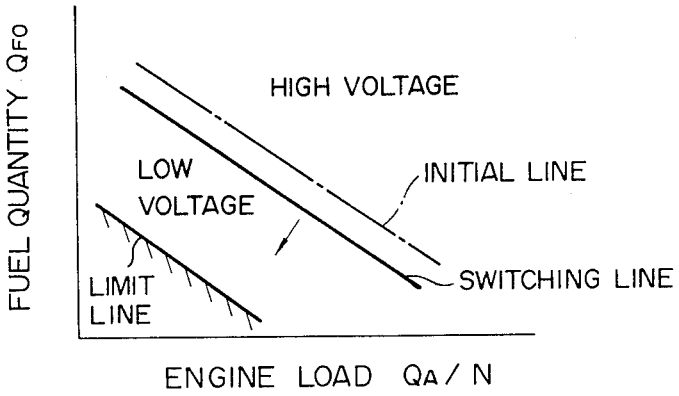
FIG. 7 is a graph for explaining the manner in which the switching line which is corrected by the control routine shown in FIG. 6.

Firstly, at a step 601, it is determined whether the relay 18 is off. In other words, it is determined whether the voltage applied to the dc motor 15 is held at the low level by the resistor 19 thus bringing the fuel pump 10 into the low speed operation. If the relay 18 is off, a transfer is made to a step 602 to determine whether the valve contact switch 14 is turned on. If the switch 14 is off, it is determined that the pressure regulating valve 13 is normally performing the pressure adjustment and thus there is no deterioration in the fuel pump 10, the dc motor 15, etc., thereby bypassing all of the remaining steps and completing the routine. If the switch 14 is on, it is considered that the pressure regulating valve 13 is not in condition for normally performing the, pressure adjustment, that is, the dc motor 15 has deteriorated with a resulting decrease in the fuel supply capacity of the fuel pump 10 to the injectors 7. Thus, a transfer is made to a step 603 to correct the map that includes $Q_{F0}$. As that as shown in FIG. 7, $Q_{F0}$ is stored in a map as a function of $Q_A/N_0$. A switching line indicates what value of $Q_A/N$ corresponds to a valve of $Q_{F0}$. FIG. 7 shows the switching line being downshifted by a required amount in the direction of an arrow so as to decrease the fuel quantity $Q_{F0}$ which is deliverable from the fuel pump 10 in accordance with the engine load $Q_A/N$. This is done in response to the positive determination at step 602. Then, this downshifted switching line is stored in the back-up RAM 30*d* at a step 604, thereby completing this routine.

On the contrary, if the relay 18 is on at the step 601, a transfer is made to a step 605 so that the count of a counter $K_1$ indicating the total high-speed operation time is increased by 1. Then, at a step 606, it is determined whether the counter $K_1$ has exceeded a predetermined value $K_{01}$. If $K_1 < K_{01}$, all the remaining steps are bypassed and this routine is completed.

On the contrary, if $K_1 \geqq K_{01}$, a transfer is made to a step 607 to determine whether the switching line has been rewritten at the step 603 to become lower than the limit line in FIG. 7. If the switching line is higher than the limit line, the following steps are bypassed and this routine is completed. If the switching line has become lower than the limit line, however, a transfer is made to a step 608 thus determining that the life limit has been reached due to the deterioration of the fuel pump 10, or the dc motor 15, etc., and a command is applied to the output port 30 to turn on the warning lamp 29 to inform the driver of the fact. Then, a transfer is made to a step 609 so that the fact of the fuel pump 10, the dc motor 15, etc., having reached their limits is stored in the back-up RAM 30*d* and the routine is completed.

Figure 8:
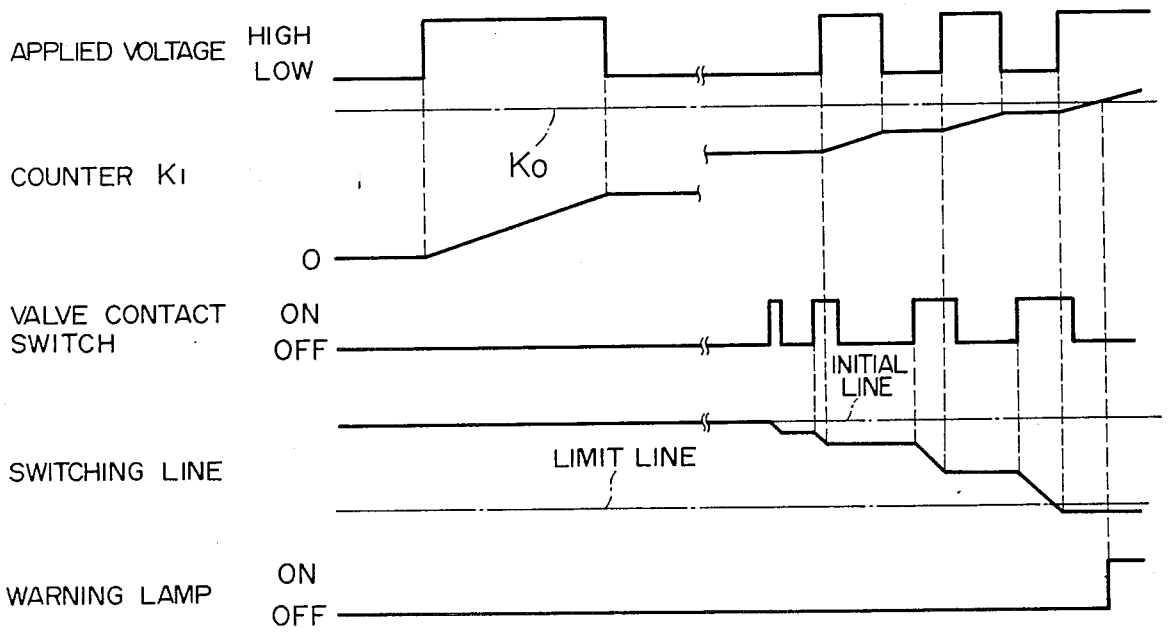
FIG. 8 is a time chart according to the control routine shown in FIG. 6.

FIG. 8 shows a time chart according to the control routine of FIG. 6, in which the counter $K_1$ maintains its count as such without counting up during the time that the applied voltage to the dc motor 15 is "low", while the count of the counter $K_1$ is counted up by 1 each time the step 605 of the control routine of FIG. 6 is performed during the "high" condition of the applied voltage. Then, when the counter $K_1$ is used over a long period of time, its count reaches the predetermined value $K_{01}$.

On the other hand, when the control routine is initiated and the valve contact switch 14 is closed during the time that the applied voltage is "low", the switching line is downshifted at the step 603. Then, when the control routine of FIG. 6 is again initiated so that at this time the applied voltage is also "low" and the valve contact switch 14 is on, the switching line is again downshifted. On the other hand, when the control routine of FIG. 6 is initiated again, if the required fuel quantity $Q_F$ of the engine 1 is decreased so that a certain amount of the fuel is supplied to the pressure regulating valve 13 and the decision of the step 602 results in "N" thereby bypassing the steps 603 and 604 or if the previous downshifting of the switching level causes the then current required fuel quantity of the engine 1 to become greater than the fuel quantity $Q_{F0}$ determined at the step 404 of the control routine in FIG. 4 so that the step 406 determines that the relay 18 be turned on to apply the high voltage to the dc motor 15, the switching line is maintained at the previously corrected position.

As a result, when the deterioration (decrease in performance) of the dc motor 15 occurs due to the use of the fuel pump 10 over a long period of time, the downshifting correction of the switching line is effected successively in response to the signals from the valve contact switch 14.

Then, when the counter $K_1$ becomes $K_1 \geqq K_{01}$ and also the switching line becomes lower than the limit line, the warning lamp 29 is turned on.

Thus, with the above-described construction, by virtue of the fact that when the valve contact switch 14 is closed during the low speed operation of the fuel pump 10 so that the deterioration of the fuel pump 10 (the dc motor 15) is confirmed and the switching line is corrected correspondingly, there is the effect of solving the problem of the deteriorated driving performance due to the insufficiently supplied fuel quantity from the injectors 7 in the low speed operation range, thereby ensuring the smooth operation. Also, due to the fact that the switching line is rewritten successively, the stable fuel supply operation of the fuel pump 10 is ensured over a long period of time. In addition, the life limit of the fuel pump 10 (the dc motor 15) can be easily determined in accordance with the total period of time of the high speed operation which took place and the condition of the switching line.

While, in the above-described embodiment, the voltage of the battery 20 is considered to be stable at all times, the voltage condition of the battery 20 is varied depending on the operating conditions of the vehicle lights, air conditioner, etc., and the degree of deterioration of the battery 20 itself and therefore it is possible to preset a switching line such that the voltage condition of the battery 20 is detected and the switching line is changed in accordance with the voltage condition by the ECU 30, thereby correcting the thus preset switching line in the previously mentioned manner. By so doing, it is possible to effect the correction due to the deterioration of the fuel pump 10 more accurately.

Figure 9:
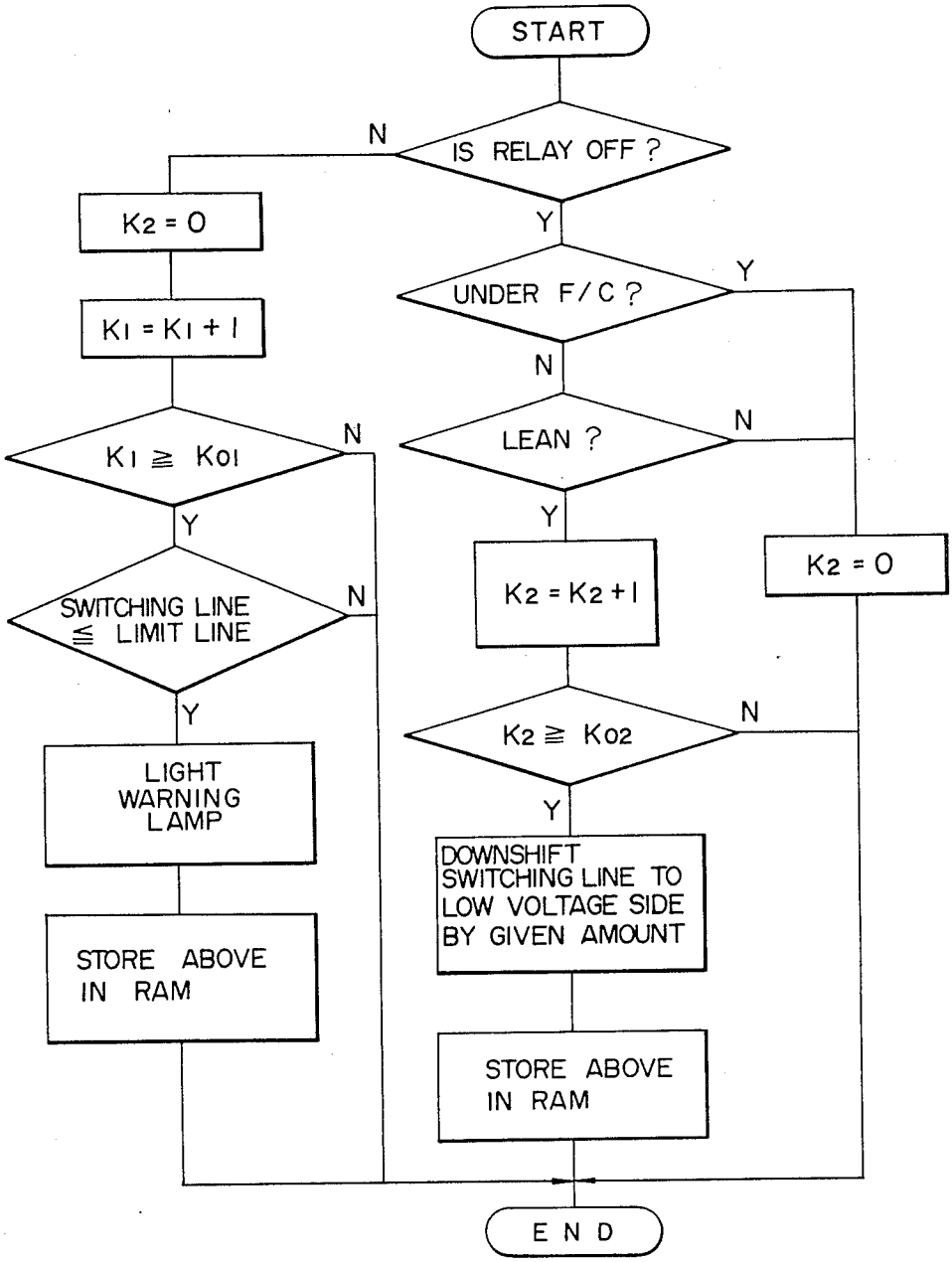
FIGS. 9, 10 and 11 are flow charts showing another embodiments of the invention.

Further, while, in the above-described embodiment, any deficiency of the fuel supply quantity to the injectors 7 is detected by the valve contact of the pressure regulating valve 13, where the $O_2$ sensor 8 is of the type which changes its state when the air-fuel ratio is leaner than a stoichiometric ratio, if, as shown in FIG. 9 for example, the $O_2$ sensor 8 generates a lean signal continuously over a predetermined time when the fuel pump 10 is operating at the low speed and moreover there is no fuel cut-off of the type which is performed during the deceleration period by a well known method, it is possible to consider that the quantity of fuel supplied to the engine 1 from the injectors 7 is decreased due to a decrease in the fuel quantity supplied to the injectors 7 from the fuel pump 10, thereby correcting the switching line.

Figure 10:
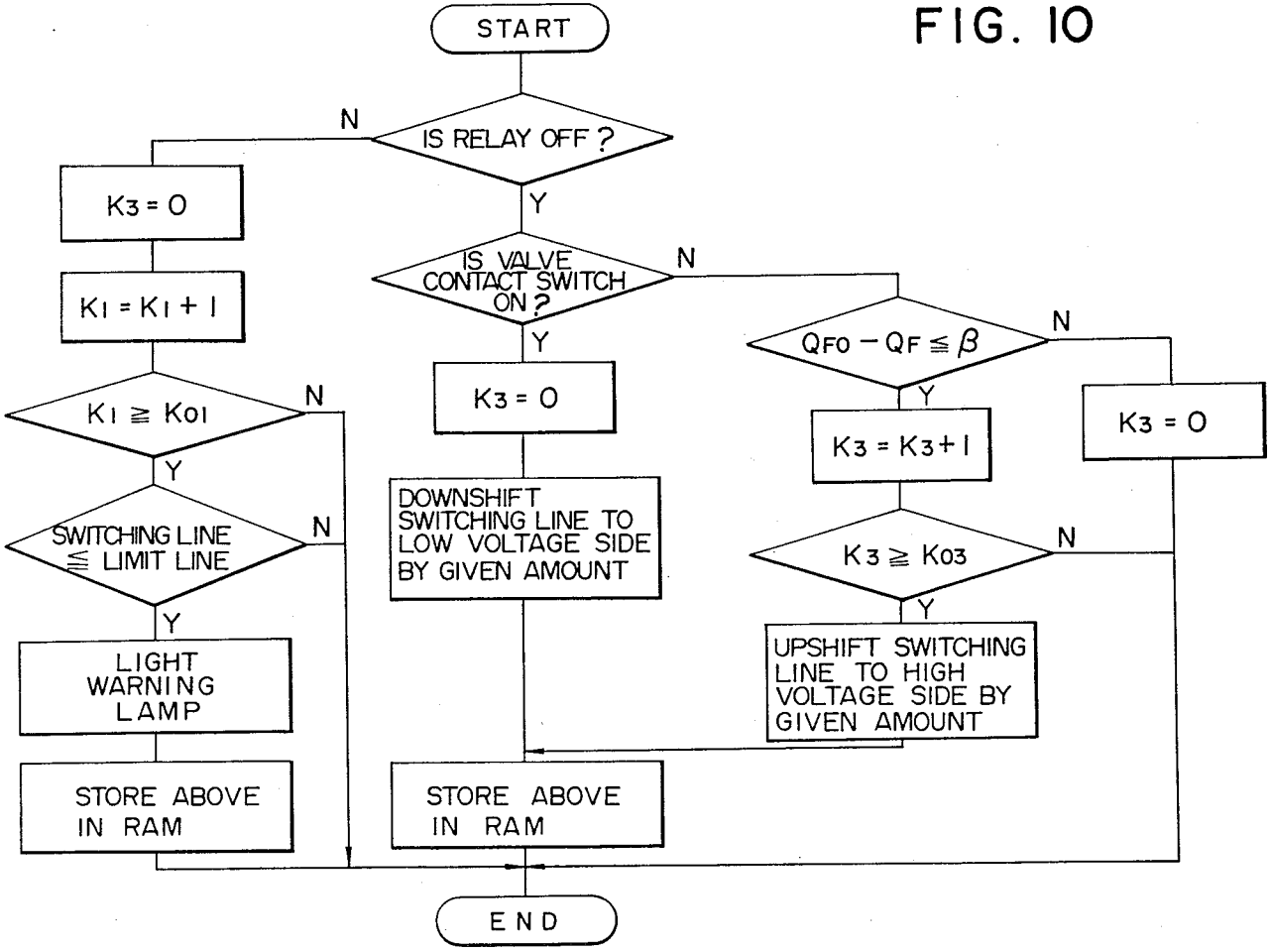

Although, in the above-described embodiment the switching line is corrected only in the downshifting direction, a still further embodiment may be made as shown in FIG. 10 where the fuel pump 10 is operating at the low speed with the valve contact switch 14 being opened and moreover the difference between the fuel quantity $Q_{F0}$ determined by the engine load $Q_A/N$ and the switching line and the required fuel quantity $Q_F$ continues to be less than a given value over a given period of time, the switching line may be corrected so as to upshift it to the high voltage side by a given amount.

Figure 11:
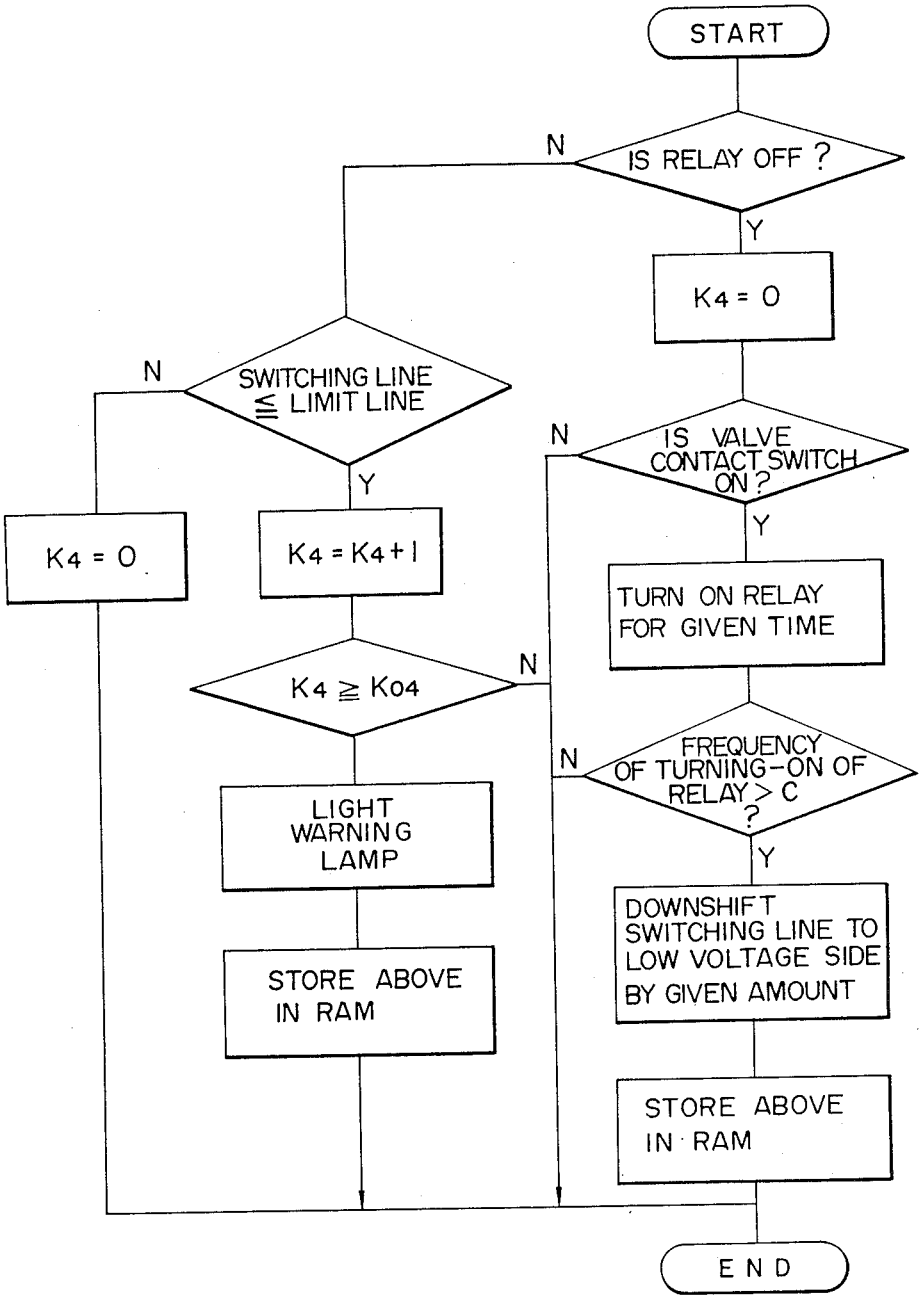
Figure 12:
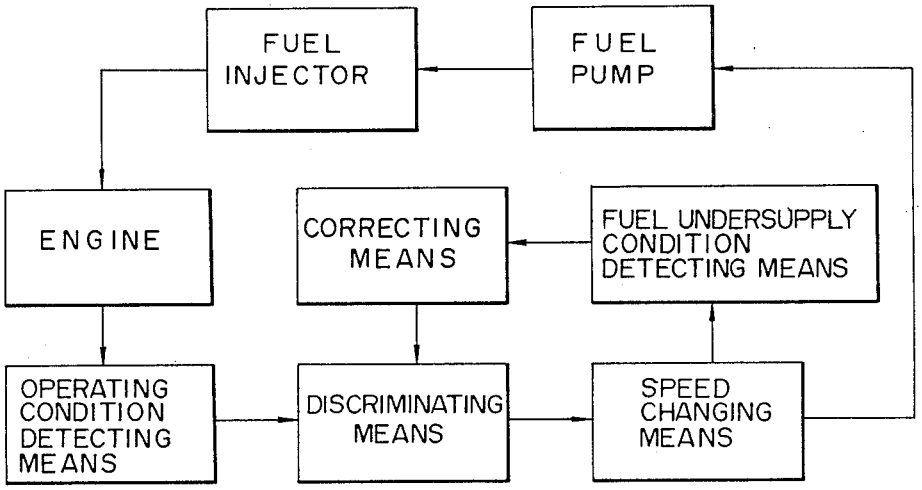
FIG. 12 is a block diagram showing schematically the construction of the invention.

Referring now to FIG. 11, there is illustrated another embodiment which differs from the first embodiment in that when the valve contact switch 14 is turned on during the low speed operation of the fuel pump 10, the relay 18 is immediately turned on for a given time and the applied voltage to the dc motor 15 is increased. By so doing, the quantity of fuel supplied to the injectors 7 from the fuel pump 10 can be increased readily. Then, it is determined whether the frequency of the relay operation that the relay 18 is turned on in response to the turning-on of the valve contact switch 14 has exceeded a given valve C. If it is greater than the given value C, the switching line is downshifted for correction and stored in the back-up RAM as in the case of the first embodiment.

While, in the first embodiment, the life of the fuel pump 10 (the dc motor 15) is determined to have come to the limit when the total high speed operation time of the fuel pump 10 is greater than a given value and the then current switching line is below the limit line, in the second embodiment the life is determined to have come to the limit when the high speed operation of the fuel pump 10 continues in excess of a given time $K_{04}$ in the state that the current switching line is below the limit line.

While, in these embodiments, the switching line itself is stored in the back-up RAM 30*c* and the thus stored switching line is successively rewritten for correction, it is possible to store the switching line itself in the ROM 30*b* and store its correction amount in the back-up RAM 30*d*.

Although the foregoing embodiments use the single compared level corresponding to a detected engine load and switch the pump speed between the two steps of high and low, they may be modified to use more than two compared levels and switch the pump speed between more than three steps.

Thus, there are great effects that any wasteful operation of the fuel pump is eliminated, that even if the deteriorated performance of the fuel pump decreases its operating speed as compared with the initial characteristic thereby making insufficient the fuel quantity supplied to the engine during the low speed operation of the fuel pump, this undersupply condition is detected to correct the reference level thereby maintaining the driving performance excellent, and that the successive corrections of the reference level ensures the stable fuel supply operation of the fuel pump over a long period of time.

In other words, the stable supply of fuel from the fuel pump can be performed positively over a long period of time while maintaining the low-speed operating condition of the fuel pump in a wide range of the engine operating conditions, that is, while eliminating wasteful operation of the fuel pump, reducing the operating sound of the pump during the idling, etc., improving the pump life, etc.

We claim:

1. An engine fuel supply control apparatus for periodically determining a required quantity for an engine, controlling the fuel quantity to the engine in response thereto and to a given corresponding comparison level and detecting a possible undersupply of fuel to modify the comparison level; said apparatus comprising:

fuel supply means including a fuel tank and a fuel pump for pumping fuel from the fuel tank to at least one fuel injector mounted on the engine;

means for detecting operating conditions of said engine;

electronic control means, including means for storing at least one given level of a required fuel quantity as a function of an engine load, CPU means for periodically determining a required fuel quantity in response to the detected operating conditions and comparing said required fuel quantity with the at least one corresponding fuel quantity level stored in said storing means to produce a fuel-up signal when the required fuel quantity is greater than or equal to the corresponding level and to produce a fuel-down signal when the former is below the latter, and means for modifying the compared corresponding fuel level in response to the detected undersupply of fuel;

means for controlling said pump to increase and decrease the fuel quantity pumped to said injector in response to said fuel-up signal and said fuel-down signal respectively; and means for detecting the undersupply of fuel to said injector to enable said modifying means with the decrease of fuel quantity decreased by said pump controlling means, wherein said undersupply detecting means is provided at an exhaust pipe of said engine, and comprises:

(a) air-fuel ratio signal outputting means for outputting a signal indicative of a rich/lean amount indicating an air-fuel ratio of air-fuel mixture supplied to said engine with a stoichiometric air-fuel ratio;

(b) counting means for counting a duration time of the lean signal outputted from said air-fuel ratio signal outputting means; and (c) discrimination means for detecting a counted duration time being not shorter than a given duration time and discriminating a fuel undersupply condition of said engine.

2. An engine fuel supply control apparatus for periodically determining a required fuel quantity for an engine, controlling the fuel quantity to the engine in response thereto and to a given corresponding comparison level, and detecting an undersupply of fuel to modify the comparison level; said apparatus comprising:

fuel supply means including a fuel tank and a fuel pump for pumping fuel from the fuel tank to at least one fuel injector mounted on the engine;

means for detecting operating conditions of said engine;

electronic control means, including means for storing at least one given level of a required fuel quantity as a function of an engine load, CPU means for periodically determining a required fuel quantity in response to the detected operating conditions and comparing said required fuel quantity with the at least one corresponding fuel quantity level stored in said storing means to produce a fuel-up signal when the required fuel quantity is greater than or equal to the corresponding level and to produce a fuel-down signal when the required fuel quantity is below the corresponding level, and means for modifying the compared corresponding fuel level in response to the detected undersupply of fuel;

means for controlling said pump to increase and decrease a fuel quantity pumped to said injector in response to said fuel-up signal and said fuel-down signal respectively; and means for detecting the undersupply of fuel to said injector to enable said modifying means with the decrease of fuel quantity decreased by said pump controlling means, wherein said fuel supply means includes a pipe line connecting said injector and said fuel tank for returning at least part of the fuel pumped to said injector, and said undersupply detecting means is provided at said pipe line for outputting an undersupply indicating signal to said electronic control means by detecting a cessation of fuel passing said pipe line, wherein said fuel supply means includes a fuel pressure regulating valve for controlling the pressure of fuel pumped to said injector to a predetermined value, and said undersupply detecting means is provided at said pressure regulating valve, wherein said modifying means changes the compared corresponding switching function to one of said functions lower by the predetermined amount in response to the detection of the undersupply of fuel of said detecting means; and said electronic control means includes means, responsive to said pump controlling means, for counting a time period while the increased fuel quantity is pumped to said injector, and means for discriminating in response to a counted time period above a given time period whether the lower switching function is below said lower limit function in order to output a discrimination signal warning of a limit of pump service life when the former function is not above the latter limit function.

3. A control apparatus according to claim 2, wherein said electronic control means includes means responsive to said fuel-down signal and to a condition where the fuel undersupply is not detected, for periodically discriminating whether the engine required fuel quantity is below the compared corresponding level by an amount not larger than a given difference counting a duration time that the amount is not larger than said given difference, and changing the compared corresponding switching function to one of said functions which is higher by a predetermined amount in response to a counted duration time above a given duration time.

4. A control apparatus according to claim 2, wherein said modifying means includes further means for increasing a pumped fuel quantity for a given period in response to the detection of the fuel undersupply by said detecting means, detecting a frequency of increase of the pumped fuel quantity responsive to said detection of the fuel undersupply, and changing the compared corresponding switching function to one of said switching functions which is lower than the compared switching function by the predetermined amount in response to the detection of the frequency above a given value.

5. A method for controlling a fuel pump and determining an erroneous operation thereof, comprising the steps of:

selectively pumping fuel from a fuel tank to an injection valve of an engine;

detecting specific operating conditions of said engine;

comparing said detected operating condition with a preset comparing level to determined if said detected operating condition corresponds to a high fuel operating condition that requires a quantity of fuel greater than or equal to a predetermined quantity;

increasing an amount of said pumping in response to a detection of said high fuel operating condition;

detecting a fuel undersupply condition to said engine while said high fuel operating condition is not being detected; and modifying said comparing level of said discriminating means when said detecting a fuel undersupply step detects said fuel undersupply condition, in a direction to clear said fuel undersupply condition.

6. A method as in claim 5 comprising the further steps of determining a limit level, and indicating an alarm when said modified comparing level has reached said limit level.

7. A method as in claim 5 comprising the further step of indicating an alarm when said high fuel operating condition occurs at a frequency of greater than a predetermined amount.

8. A control apparatus for controlling a fuel pump of an engine that is adapted for supplying fuel to at least one fuel injection valve supplying fuel to said engine, comprising:

first detecting means for a detecting an operating condition of said engine;

means, connected to said first detecting means, for discriminating based on a preset comparing level whether said detected operating condition corresponds to a high fuel operating condition, that requires a quantity of fuel greater than or equal to a predetermined quantity;

control means for controlling said fuel pump means to increase a quantity of fuel pumped from said tank in response to said discriminating means discriminating said high fuel operating condition;

second detecting means for detecting a fuel undersupply condition of said engine while said high fuel operating condition is not being detected; and means for modifying said comparing level of said discriminating means in a direction to clear the detected fuel undersupply condition when said second detecting means detects said fuel undersupply condition while said high fuel operating condition is not being detected.

9. A control apparatus according to claim 8, further including a fuel distributing pipe, connected to said fuel pump means, for returning a part of the fuel pumped by said pump means that was not supplied from said injection valve for combustion in said second detecting means is provided at said fuel distributing pipe and detects a quantity of fuel passing said pipe which is not larger than a predetermined quantity.

10. A control apparatus according to claim 8, wherein said fuel pump means includes a fuel pressure regulating valve for controlling the pressure of fuel pumped to said injection valve to be a predetermined value, and wherein said second detecting means is provided at said pressure regulating valve.

11. A control apparatus according to claim 8, further including means for presetting a limit level and alarm means for indicating an alarm by detecting said comparing level modified by said modifying means having reached said limit level.

12. A control apparatus according to claim 8, further including counter means for maintaining a cumulative count of a period of time during which said control means controls said fuel pump means to increase the quantity of fuel pumped by said pump means, and alarm means for determining and indicating an alarm by detecting the cumulatively counted period of time having exceeding a predetermined period of time.

13. A control apparatus according to claim 8, further including:

counter means for counting a period of time when said control means does not control said pump means to increase the quantity of fuel driven by said pump means from said tank while said second detecting means does not detect a fuel undersupply condition and while said first detecting means detects an engine operating condition where said engine demands a quantity of fuel in the vicinity of said predetermined quantity; and alteration means for changing said comparing level by a predetermined magnitude in the opposite direction to that of said modifying by said modifying means when said counter means counts a period of time equal to or longer than a predetermined period of time.

14. A control apparatus according to claim 8, further including second control means for controlling said fu®1 pump means for a predetermined period to increase the quantity of fuel pumped by said pump means for said tank in response to said second detecting means detecting a fuel undersupply condition, whereby said modifying means modifies said comparing level when said second control means controls said fuel pump means at a frequency higher than a predetermined value for a predetermined interval.

15. A control apparatus according to claim 8, wherein said second detecting means is provided at an exhaust pipe of said engine, further including:

means for outputting a signal indicative of an amount of rich/lean of air-fuel mixture supplied to said engine with a stoichiometric air-fuel ratio;

counting means for counting a duration time of a lean signal outputted from said signal outputting means; and discrimination means for detecting a counter duration time not shorter than a given duration time, thereby discriminating a fuel undersupply condition of said engine.

16. A control apparatus according to claim 8, further including calculation means for calculating a fuel quantity to be injected by said injection valve on the basis of said engine operating condition detected by said first detecting means, and means for determining the engine demanding fuel quantity on the basis of the calculated fuel quantity.

* * * * *